US009587907B2

(12) United States Patent
Baker et al.

(10) Patent No.: US 9,587,907 B2
(45) Date of Patent: Mar. 7, 2017

(54) SCOPE GUARD APPARATUS AND SYSTEM

(71) Applicants: Jacob Baker, Sheridan, IL (US); John Baker, Sheridan, IL (US)

(72) Inventors: Jacob Baker, Sheridan, IL (US); John Baker, Sheridan, IL (US)

( * ) Notice: Subject to any disclaimer, the term of this patent is extended or adjusted under 35 U.S.C. 154(b) by 0 days.

(21) Appl. No.: 14/465,193

(22) Filed: Aug. 21, 2014

(65) Prior Publication Data

US 2015/0052796 A1 Feb. 26, 2015

Related U.S. Application Data

(60) Provisional application No. 61/868,463, filed on Aug. 21, 2013.

(51) Int. Cl.
*F41C 27/00* (2006.01)
*F41A 35/02* (2006.01)

(52) U.S. Cl.
CPC ..... *F41C 27/00* (2013.01); *F41A 35/02* (2013.01)

(58) Field of Classification Search
CPC ..... F41C 27/00; F41C 27/04; F41A 35/02; F41G 1/04; F41G 1/065
USPC ..... 42/143
See application file for complete search history.

(56) References Cited

U.S. PATENT DOCUMENTS 3,977,113 A * 8/1976 Howell ..... F41G 1/383 42/129
4,734,989 A * 4/1988 Sanders ..... F41G 1/04 42/137
5,155,915 A * 10/1992 Repa ..... F41G 1/383 42/127
7,484,856 B1 * 2/2009 Newhall ..... F41G 1/04 359/511
2014/0026463 A1 * 1/2014 Park ..... F41G 1/383 42/129

* cited by examiner

*Primary Examiner* — Bret Hayes
(74) *Attorney, Agent, or Firm* — Maier & Maier, PLLC

(57) ABSTRACT

An apparatus for protecting weapons and weapon accessories. The apparatus has one or more fittings located on a lower portion of a mounting area on the apparatus. The one or more fittings are attached to corresponding mounting sites on an upper portion of a mounting area on a weapon. A frame is affixed to one or more fittings to provide protection for the weapon and weapon accessory in the event of a collision or trauma.

5 Claims, 14 Drawing Sheets

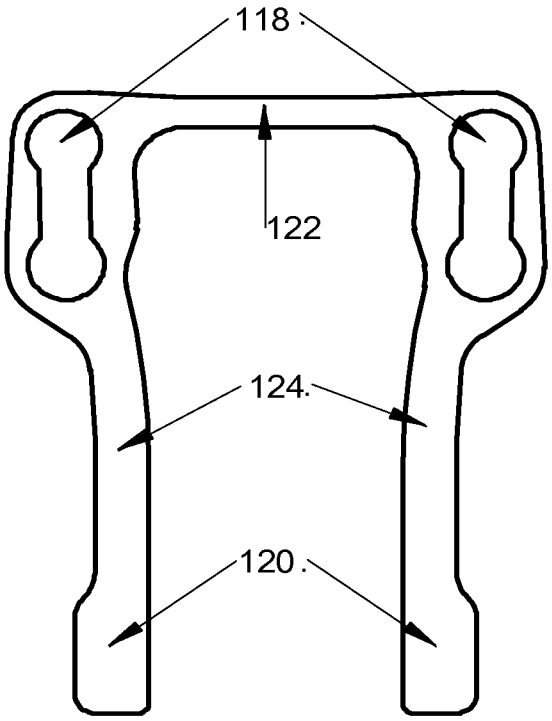
Fig, 4C

110

SCOPE GUARD APPARATUS AND SYSTEM

PRIORITY CLAIM

This application claims prior to U.S. provisional patent application Ser. No. 61/868,463, filed on Aug. 21, 2013, the contents of which are hereby incorporated by reference in their entirety.

BACKGROUND

Many modern shooting accessories, such as scopes or sights, may be attached to a variety of firearms, generally to improve the functionality or usability of those firearms. Known accessories include scopes, holographic sights, red dot sights, and reflex sights. These accessories may be used wherever firearms or similar weapons may be employed, such as for hunting, law enforcement, military, personal defense, or recreational target shooting. Mounts, such as ring mounts, are used to couple an accessory to a weapon. For example, a gun may have a scope mount on its stock, which may permit an after-market scope to be attached to the gun after it has been purchased. This may improve the user's ability to operate the gun, for example by making it easier for the user to aim the gun at long-distance targets.

Other devices may similarly incorporate scopes. Many hunters, for example, choose to hunt with modernized crossbows; these weapons may also include mounting sites for a scope, or may be sold with a scope pre-mounted to the stock. Scoped devices also may not exclusively be weapons; many cameras, telescopes, and other optical sensing devices may include viewfinding scopes that may allow a user to align the device.

These devices, especially weapons, weapon components, and attached accessories, often incorporate sensitive, high technology parts. Further, such devices often require meticulous calibration and installment in order to ensure proper functionality. Despite the fact that maintaining the integrity of weapons and accessories is critical to their functionality, these components are typically not protected and are highly susceptible to damage during normal use.

SUMMARY

According to at least one exemplary embodiment, a scope guard may be coupled to a weapon or other device to protect one or more accessories, such as a scope, holographic sight, red dot sight, reflex sight or the like. The scope guard may also protect the device itself or its components, for example the rail or action of a gun. This scope guard may be based around a rigid frame that may enclose the accessories, or alternatively may be based around a specialized ring mount or series thereof that may do the same. The scope guard may further include a number of guard bars that may provide further reinforcement to the apparatus.

Additionally, in some further exemplary embodiments, the scope guard may be able to mount a number of panels, which may be used to further protect or conceal the device, its components, or its accessories; for example, a camouflage panel could be used to help conceal a gun's scope from hostile forces. Further refinements to the scope guard may be made in order to improve its functionality; for example, the scope guard may be constructed from a lightweight material to reduce any detrimental effects it may have on the user's aim.

BRIEF DESCRIPTION OF THE FIGURES

Advantages of embodiments of the present invention will be apparent from the following detailed description of the exemplary embodiments thereof, which description should be considered in conjunction with the accompanying drawings in which like numerals indicate like elements, in which:

FIG. 4C is an exemplary embodiment of a mounting ring.

DETAILED DESCRIPTION OF THE EMBODIMENTS

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

The word "exemplary" is used herein to mean "serving as an example, instance, or illustration." Any embodiment described herein as "exemplary" is not necessarily to be construed as preferred or advantageous over other embodiments. Likewise, the term "embodiments of the invention" does not require that all embodiments of the invention include the discussed feature, advantage or mode of operation.

Figure 1:
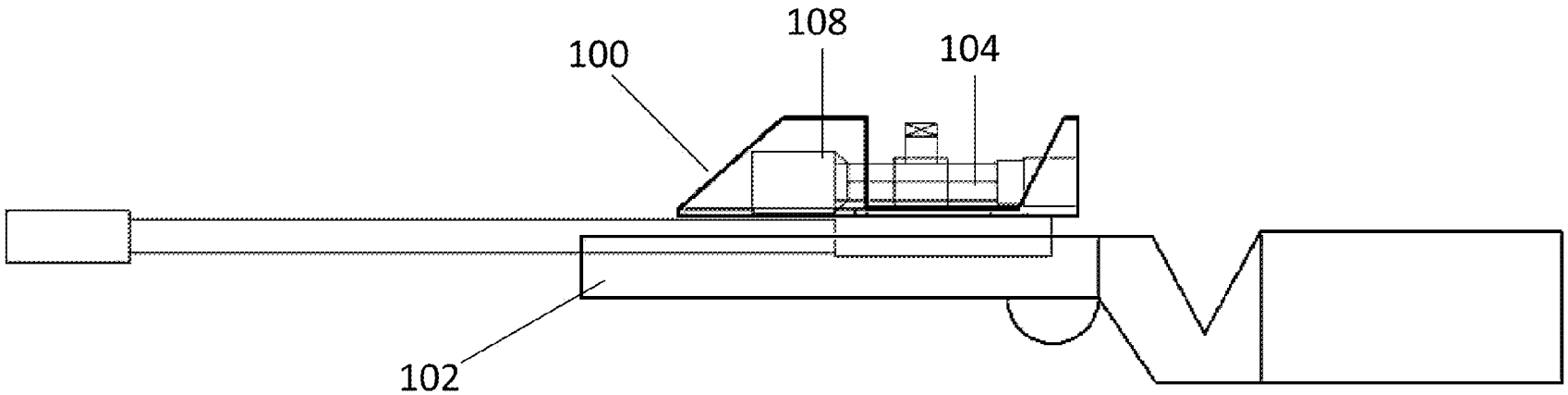
FIG. 1 is an exemplary diagram of a scope guard as shown attached to a firearm, the scope guard having a rigid frame design.

Referring now to exemplary FIG. 1, a scope guard 100 can be fitted to a weapon 102, such as, but not limited to, a rifle, pistol, or other firearm, to protect one or more accessories 104 that may be coupled to the weapon 102. Any exemplary accessories 104 utilized could be scopes, holographic sights, red dot sights, reflex sights or the like. An accessory 104 may have any functionality as known or desired. An accessory 104 may be coupled to the weapon 102 in any variety of fashions or manners as desired. The fittings of the scope guard 100 may be fixed in place or may be adjustable, and may be configured to removably couple exclusively to rifles, exclusively to pistols, exclusively to other weapons, or to more than one of the above; for example, a scope guard 100 may be configured to connect to a standard Weaver or Picatinny rail system, or to any other accessory mounting systems. Alternatively, the scope guard 100 may be connected to the weapon 102 by screws, bolts, clamps, a permanent connection such as a weld, or any other desired connector. Interchange of the scope guard 100 between different types of weapons with differently-placed mounts may be accomplished via adjusting the fittings of the scope guard 100 as discussed above.

In one exemplary embodiment, the scope guard 100 may have one or more panels 108 that allow a weapon user to protect and conceal accessories 104 from collisions, shock, trauma, brush, clothing, other gear, enemies, intruders or other opposition forces. The panels 108 may be interchangeable. Each panel 108 can be designed to have a desired shape and color scheme, such as camouflage, that can allow the scope guard 100 to conceal the outline of the weapon 102. Panel 108 designs can be adapted for use in different environments, for example jungle, desert, and urban environments, or any other environment, as desired.

Figure 2:
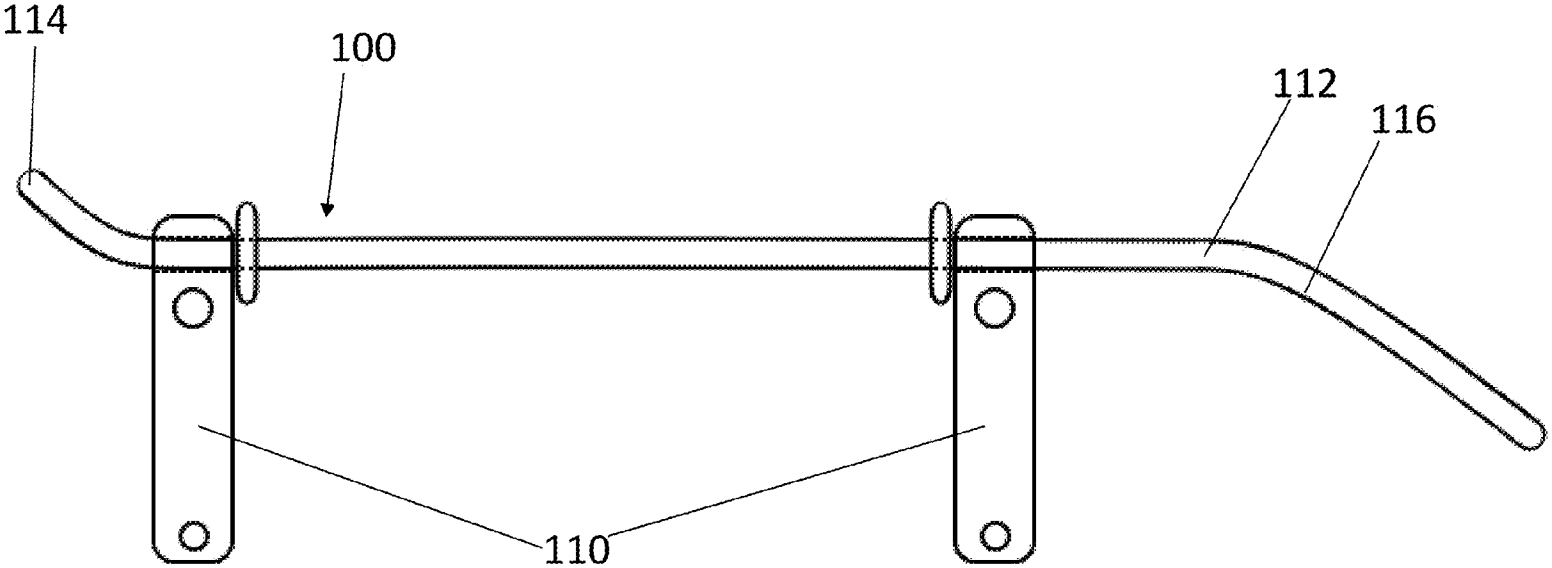
FIG. 2 is an exemplary diagram of a scope guard, the scope guard having a "ring-and-bar" design.
Figure 3:
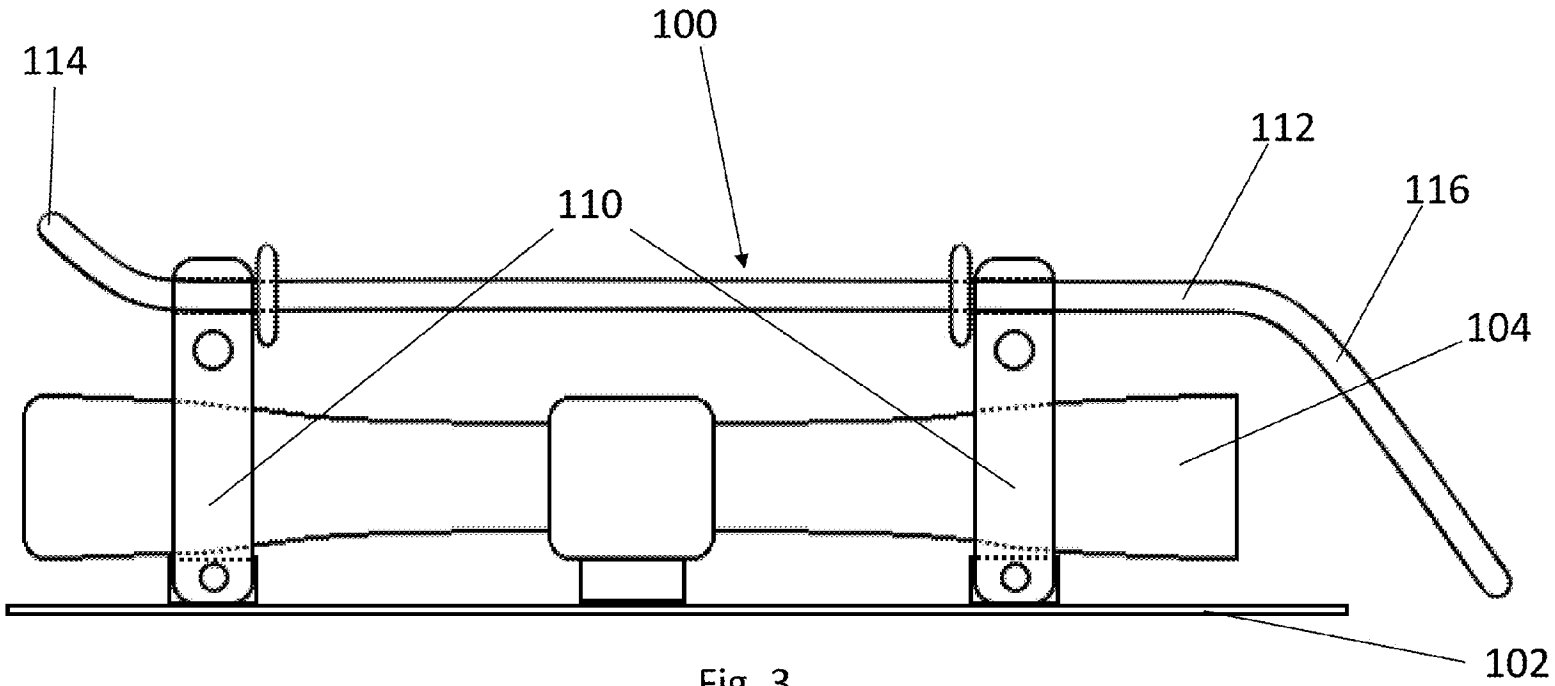
FIG. 3 is an exemplary diagram of a scope guard as shown attached to a firearm, the scope guard having a "ring-and-bar" design.

Referring now to exemplary FIGS. 2-3, a scope guard 100 can have one or more ring mounts 110 that allow a weapon user to protect and conceal accessories 104 from collisions, shock, trauma, brush, clothing, other gear, enemies, intruders or other opposition forces. As shown in exemplary FIG. 3, the ring mounts 110 may fit around an accessory 104 and mount directly to the stock of the weapon 102. Alternatively, the ring mounts 110 may be mounted directly to the accessory 104, or may be mounted as desired. The ring mounts 110 may be interchangeable. Each ring mount 110 can be designed to have a desired shape and color scheme, such as camouflage, that can allow the scope guard 100 to conceal the outline of a weapon 102. Ring mount 110 designs can be adapted for use in different environments, as above. The ring mounts 110 may be fitted to a weapon 102 via any desired manner.

According to the exemplary embodiments displayed in FIGS. 2-3, the remainder of the scope guard 100, apart from the one or more ring mounts 110, may be substantially formed of a single continuous bar 112. Guard bar 112 may have upward-facing exposed ends 114 near the eyepiece end of the scope guard 100 (that is, the left side of FIGS. 2 & 3), and a downward-facing loop 116 on the other side of the scope that may pass under the objective lens and rest on the gun stock or barrel. In an alternative embodiment, more than one guard bar 112 may be used; for example, the scope guard 100 may have downward-facing exposed ends where the downward-facing loop is in FIGS. 2-3. According to this embodiment, guard bars 112 may be placed as desired; for example, according to the previous embodiment, guard bars 112 may be located above the scope or other accessory 104 and may be placed on either side of the scope. Guard bars 112 may be held in place by way of a bracket, a ring or washer, a thickness increase or decrease in the bar near where it passes the one or more ring mounts 110, or otherwise as desired.

In another exemplary embodiment, the scope guard 100 can have a combination of one or more ring mounts 110 and one or more panels 108 that can provide for protection and concealment of the weapon 102 and any accessories 104 thereto from collisions, shock, trauma, brush, clothing, other gear, enemies, intruders or other opposition forces. The scope guard 100 may partially or fully encapsulate one or more accessories 104 or components, including, for example, a sight, stock, or barrel. Panels 108 may mount to the ring mounts 110, to elsewhere on the scope guard 100, to elsewhere on a device to which the scope guard may be mounted 102, or elsewhere, as desired.

In some exemplary embodiments, the scope guard 100 utilized herein may provide protection to components of a weapon 102 itself. For example, if mounted to a weapon 102, the scope guard 100 may protect the barrel, stock, rail, and/or action. According to such an embodiment, if the weapon 102 was brushed against a tree branch, the scope guard 100 may protect optics mounted on the weapon from being damaged, disturbed or dislodged by the impact. The scope guard 100 may partially or fully encapsulate any weapon components or accessories 104 as desired, or may partially or fully encapsulate a weapon or other device.

Any scope guard 100 described herein may be made out of metal, for example aluminum, magnesium, titanium, steel, other alloys, or any combination thereof. Further, any scope guard 100 utilized herein may be made of plastics, composites, resins, epoxies, laminates, glass, carbon fiber, or any combination thereof and may be shaped via various extruding, molding, vacuum forming, casting processes or any combination thereof. A scope guard 100 may also be made of both metal and nonmetal components, for example employing metal mounting brackets and a carbon fiber frame, or may be constructed as desired.

In further exemplary embodiments, the scope guard 100 used herein can be substantially lightweight, relative to the weapon 102 to which it is attached. This may allow that the weight and balance of the weapon 102 to which the scope guard 100 is attached is not adversely affected by the addition of the scope guard 100. For example, if attached to a firearm, the lighter weight of the scope guard 100 may provide that the user of the firearm does not tire more easily, experience loss of accuracy when shooting the firearm, or otherwise suffer impairment in their use of the firearm.

Exemplary FIGS. 4A-4K illustrate a number of embodiments of the ring mounts 110. Ring mounts 110 may include a hole or a plurality of holes 118 through which guard bars 112 may be passed, and may include a mounting bracket or plurality of mounting brackets 120 that may allow the ring mount 110 to be attached to the stock of a firearm or other device 102. Holes 118 that may serve as guard bar mounting sites may be fully separated from each other, or may be connected via a slot or channel; the latter may permit the ring mount 110 in response to an impact. Ring mounts 110 may also include a support bridge 122 that may serve to link the vertical supports 124 of the ring mount 110; support bridge 122 may be located at the top of the ring mount 110 (as in FIG. 4B), nearer the center of the ring mount 110 (as in FIG. 4A), near the lower portion of the ring mount 110, or may be absent entirely. If the support bridge 122 is absent, the ring mount 110 may have multiple pieces, each of which may mount to one side of the mounting sites on the firearm or other device 102; this may allow the ring mounts 110 to be assembled around the scope or other accessory to be protected 104, allowing for a tighter fit or for a more complex shape in the ring mount 110.

Figure 4A:
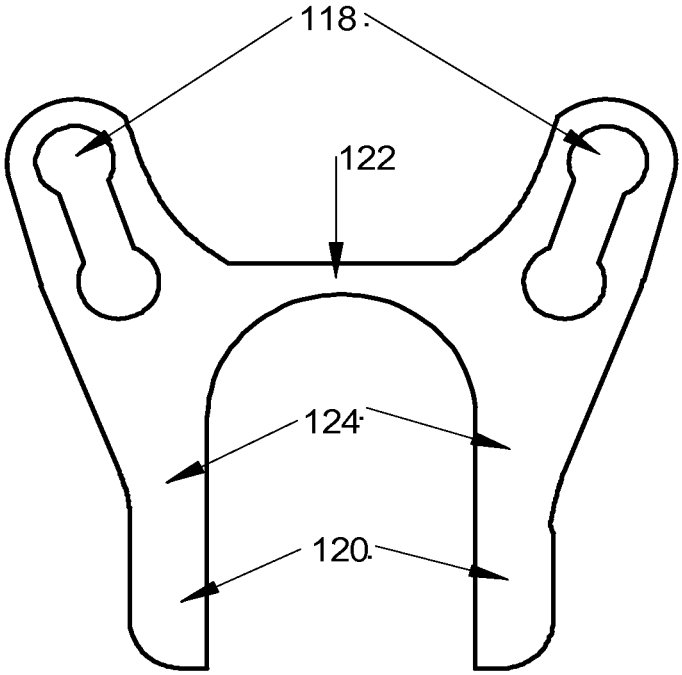
FIG. 4A is an exemplary embodiment of a mounting ring.
Figure 4B:
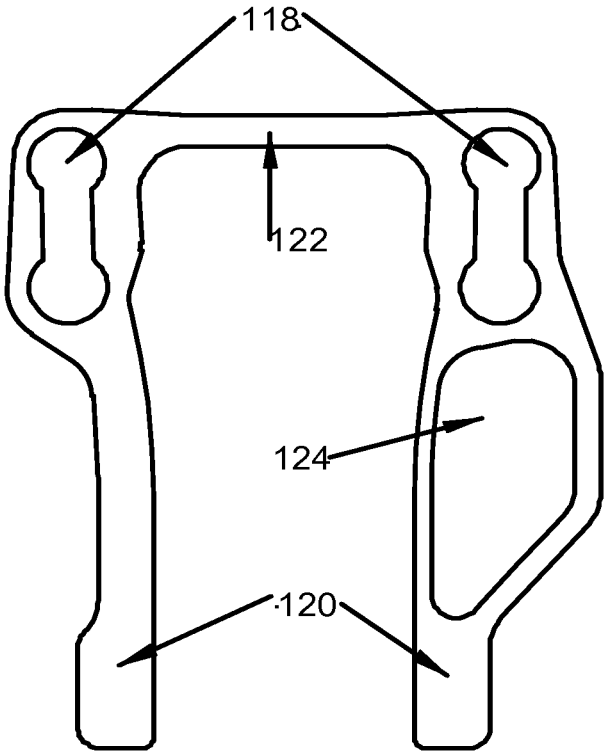
FIG. 4B is an exemplary embodiment of a mounting ring.

Differently-shaped ring mounts 110 may be used to accommodate a broader set of firearms or other devices 102; for example, the ring mount 110 shown in FIG. 4A may have a smaller internal cavity under the support bridge 122 than does the ring mount shown in FIG. 4B, which may allow the ring mount 110 shown in FIG. 4B to be used with a wider selection of scopes and other accessories 104. Ring mounts 110 may also be symmetrical along at least one axis, for example as in FIG. 4A, or may be asymmetrical, as in FIG. 4B; this symmetry or asymmetry may, for example, be exhibited in the vertical supports 124 having different shapes or sizes, or as desired. Asymmetrical ring mounts 110 may be employed to protect weapons 102 or weapon components 104 that are asymmetrical or asymmetrically placed. For example, a rifle scope may have a dial system that extends only from one side of the scope and which is sensitive to damage; in such an example, an asymmetrical ring mount 110 wherein one side of the ring mount 110 is significantly wider than or extends out further than the other side of the ring mount 110 (as in exemplary FIG. 4B or FIG. 4E) may be chosen. Using such a ring mount 110 may ensure that, should a weapon 102 be dropped with scope guard 100 attached, the asymmetrical component 104 will not come into contact with the ground, or may protect the asymmetrical component 104 from other sources of damage.

Briefly summarizing FIGS. 4A-4K, embodiments of ring mounts 110 may take a number of forms. FIG. 4A features a symmetrical design with a centrally located support bridge 122. The design features a plurality of mounting holes 118 for guard bars 112, permitting the guard bars 112 to be installed nearer or farther from the base of the ring mount 110, as desired. This may permit the protection provided by the guard bars 112 to be sized appropriately to protect smaller or larger accessories 104, for example scopes with larger or smaller diameters. Ring mount 110 may feature a mounting bracket 120 or a plurality thereof; these may be located near the base of the ring mount 110 and may facilitate attachment to a rail system or other mounting site located on a weapon or other device. Locating the support bridge 122 in the center of the ring mount 110 may be advantageous by permitting the ring mounts 110 to flex to a greater degree when faced with an impact originating from the top side of the ring mounts 110 (such as if a weapon to which a scope guard 100 is attached is dropped directly on its top side), which may allow the ring mounts 110 to absorb more of the energy of such an impact. This may ensure that a weapon or accessory protected by the scope guard 100 is protected to a greater degree.

FIG. 4B features an asymmetrical design with a top support bridge 122. As in FIG. 4A and as in subsequent figures, the design features a plurality of mounting holes 118 for guard bars 112, permitting the guard bars 112 to be installed nearer or farther from the base of the ring mount 110, as desired. Again, this may permit the protection provided by the guard bars 112 to be sized appropriately to protect smaller or larger accessories 104, for example scopes with larger or smaller diameters. Likewise as in FIG. 4A, ring mount 110 may feature a mounting bracket 120 or a plurality thereof; these may be located near the base of the ring mount 110 and may facilitate attachment to a rail system or other mounting site located on a weapon or other device.

The embodiment shown in FIG. 4B may be primarily distinguished from that of FIG. 4A by the higher placement of the support bridge 122 and by the different widths and shapes of the plurality of vertical supports 124. The higher placement of the support bridge 122 may allow for larger accessories to fit between the support bridge 122 and the base of the ring mount 110, allowing a scope guard 100 to be used with a wider range of accessories and broadening the number of users that may have use for a scope guard 100. Likewise, the different widths of the plurality of vertical supports 124 may allow for a broader range of accessory shapes to be used with the scope guard 100 while still placing those accessories within the confines of the protection provided by the scope guard 100. For example, if a scope with a dial system that extends only from one side of the scope is to be protected by a scope guard 100 including ring mounts 110, ring mounts 110 similar to those in FIG. 4B may be chosen, and the wider vertical supports 124 placed on the side shared with the dial system extending from the side of the scope. According to such a configuration, if the user should drop the weapon or other device featuring the asymmetrical scope, and should the weapon or other device impact the ground on the side featuring the scope dial system, the energy of the impact from the fall may be absorbed by the wider vertical support 124 instead of by the dial system. Other collisions, shocks, trauma, or other potential source of damage to an asymmetrical system may be protected against in a similar fashion. According to the preferred embodiment, the internal portion of the wider vertical support 124 may be hollow; this may reduce material costs and may permit the wider vertical support 124 to deform or crumple in response to an impact, further increasing the energy absorption potential of the wider vertical support 124 and offering further protection to any enclosed accessories or components.

The exemplary embodiment shown in FIG. 4C incorporates features previously shown in the embodiments of FIGS. 4A and 4B. As in FIG. 4A, the vertical supports 124 are symmetrical and narrow, which may offer advantages like ease of machining or the resulting scope guard 100 having a lower profile. However, as in FIG. 4B, the support bridge 122 is located at the top portion of the ring mount 110, which may permit larger scopes or other accessories to be used with the ring mount.

Figure 4D:
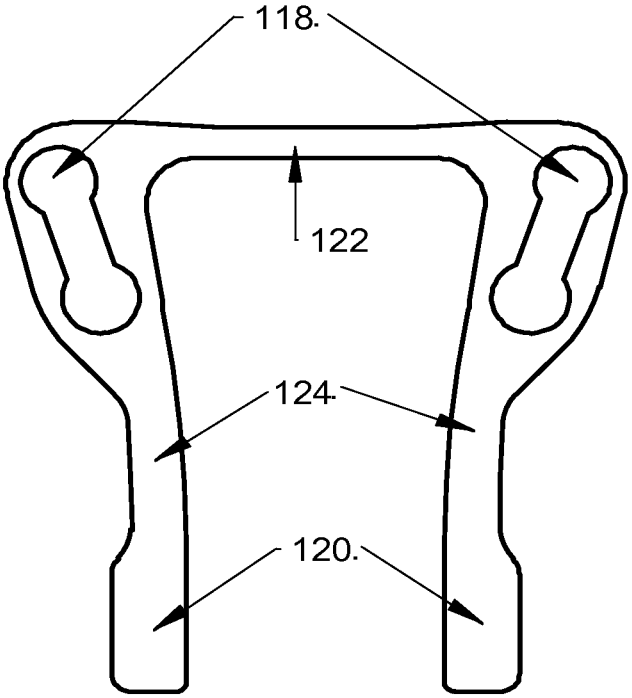
FIG. 4D is an exemplary embodiment of a mounting ring.

The exemplary embodiment of FIG. 4D is similar to that of FIG. 4C, having only a wider topmost portion to distinguish it. This may permit still larger accessories to be used with the ring mount 110, with the potential trade-off being a slightly larger profile.

Figure 4E:
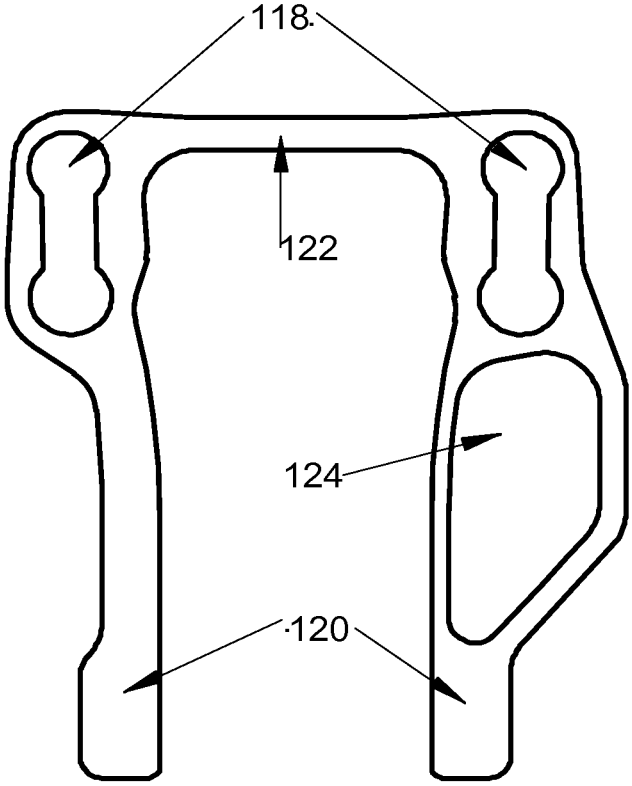
FIG. 4E is an exemplary embodiment of a mounting ring.

The embodiment of FIG. 4E is similar to that of FIG. 4C, having only a wider vertical support to distinguish it. This may permit the ring mount 110 to better accommodate an asymmetrical accessory.

Figure 4F:
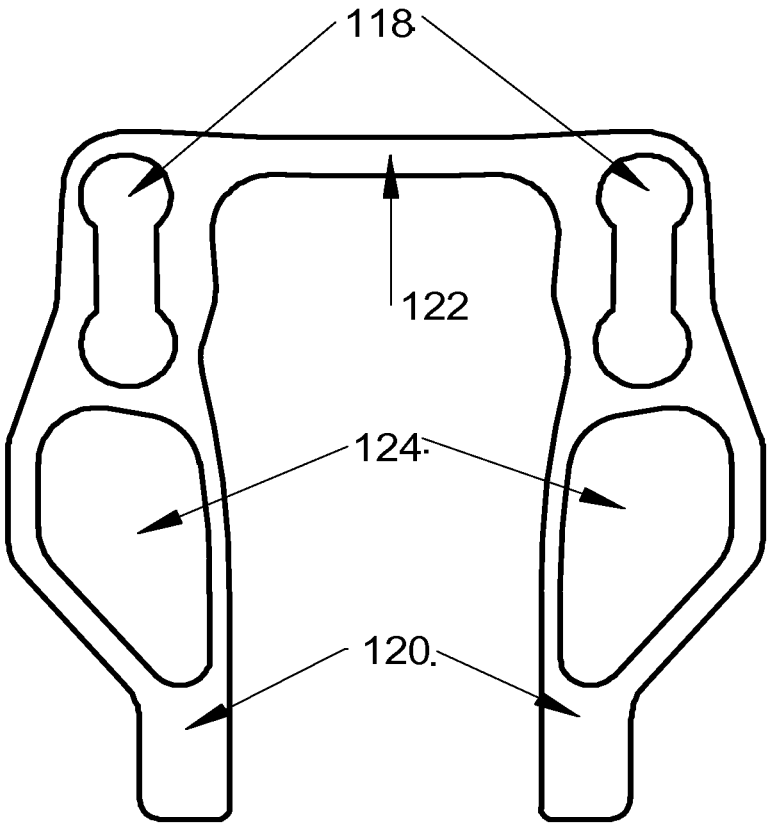
FIG. 4F is an exemplary embodiment of a mounting ring.

The exemplary embodiment of FIG. 4F is also similar to that of FIGS. 4C and 4E, with the distinction in this case being that both vertical supports 124 have been widened. This may offer added protection to particularly wide accessories, such as a scope with a dial on each side. Such an embodiment may also offer user convenience; the added widened vertical support as compared to the embodiment of FIG. 4E may ensure that a user that wishes to trade out one asymmetrical accessory for another does not need to disassemble the scope guard 100, remove the ring mount 110, flip it around, and install it again with the wider vertical support 124 facing the other direction. Instead, the user may be able to simply remove the original asymmetrical accessory and install the new one in its place, without having to deal with disassembling and reassembling the scope guard 100.

Figure 4G:
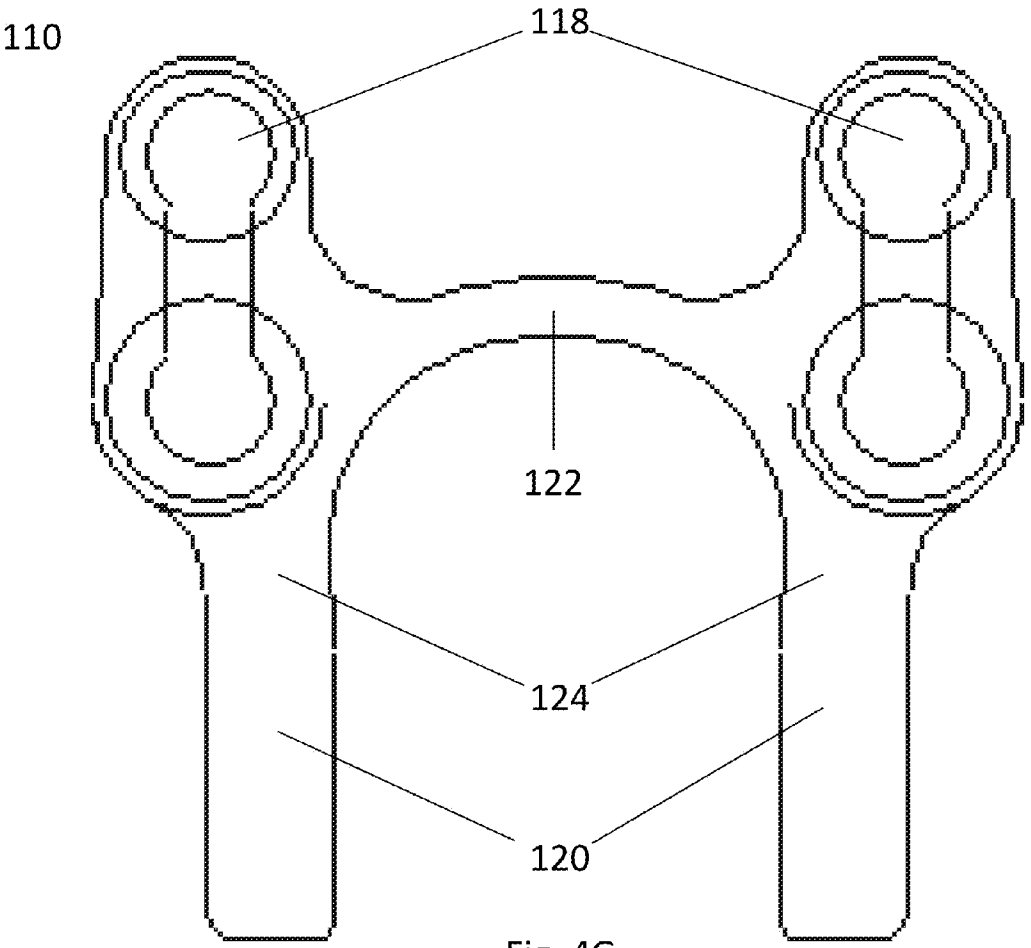
FIG. 4G is an exemplary embodiment of a mounting ring.

The exemplary embodiment of FIG. 4G is similar to that of FIG. 4A, with some minor distinctions. For example, the internal cavity under the support bridge 122 is fully rounded rather than a rounded rectangle; this may make the embodiment shown in FIG. 4G better suited to accommodate different kinds of accessories. The design also may permit narrower vertical supports 124 to be used, which may decrease manufacturing costs and reduce the profile of the scope guard 100.

Figure 4H:
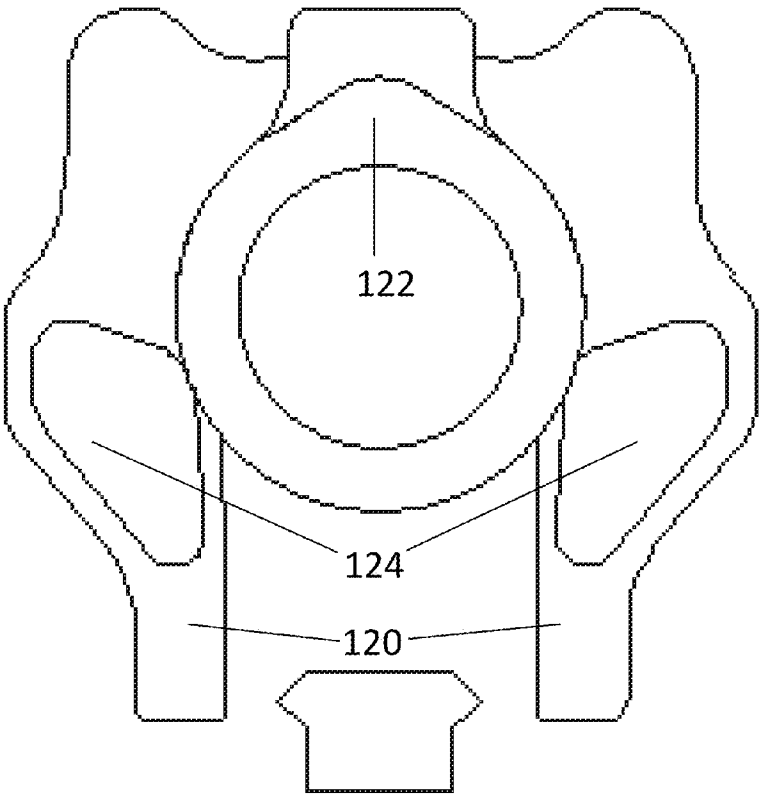
FIG. 4H is an exemplary embodiment of a mounting ring.

Exemplary FIG. 4H illustrates an embodiment of a ring mount 110 that lacks any mounting sites for guard bars 112. Instead, a weapon and/or an accessory may be directly shielded by the ring mount; for example, an accessory such as a scope or flashlight may be placed in the large internal cavity under the support bridge 122, and protected directly by the ring guard 110. According to this embodiment, the vertical supports 124 of the ring mount 110 may be widened to ensure that the ring mount 110 features greater protection against collisions, shocks, and other potential sources of damage. The ring mount 110 may also, for example, feature shock-absorbing "feet" near its topmost portion to ensure that the ring mount 110 and any accessories enclosed within it are adequately protected against an impact to the top of the ring mount 110; these feet may bend or flex in response to such an impact, reducing the energy of the impact that may be absorbed by the ring mount, by an attached device, or by any accessories.

Figure 4I:
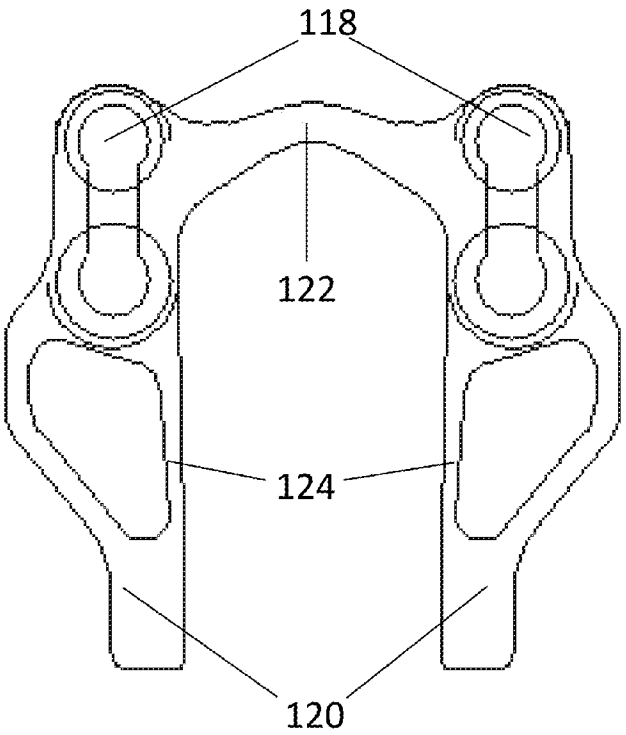
FIG. 4I is an exemplary embodiment of a mounting ring.

Exemplary FIG. 4I illustrates an embodiment of a ring mount 110 close to that of FIG. 4G. The embodiment of FIG. 4I may be distinguished by its use of a curved support bridge 122 instead of a flat support bridge 122 as in FIG. 4G; the use of a curved support bridge 122 may be advantageous because it may allow the ring mount 110 to flex to a greater degree in response to an impact, which may in turn increase the energy absorption characteristics of the support bridge. The embodiment of FIG. 4I also has a slightly larger internal cavity, which may permit slightly larger accessories to be used in conjunction with the scope guard 100.

Figure 4J:
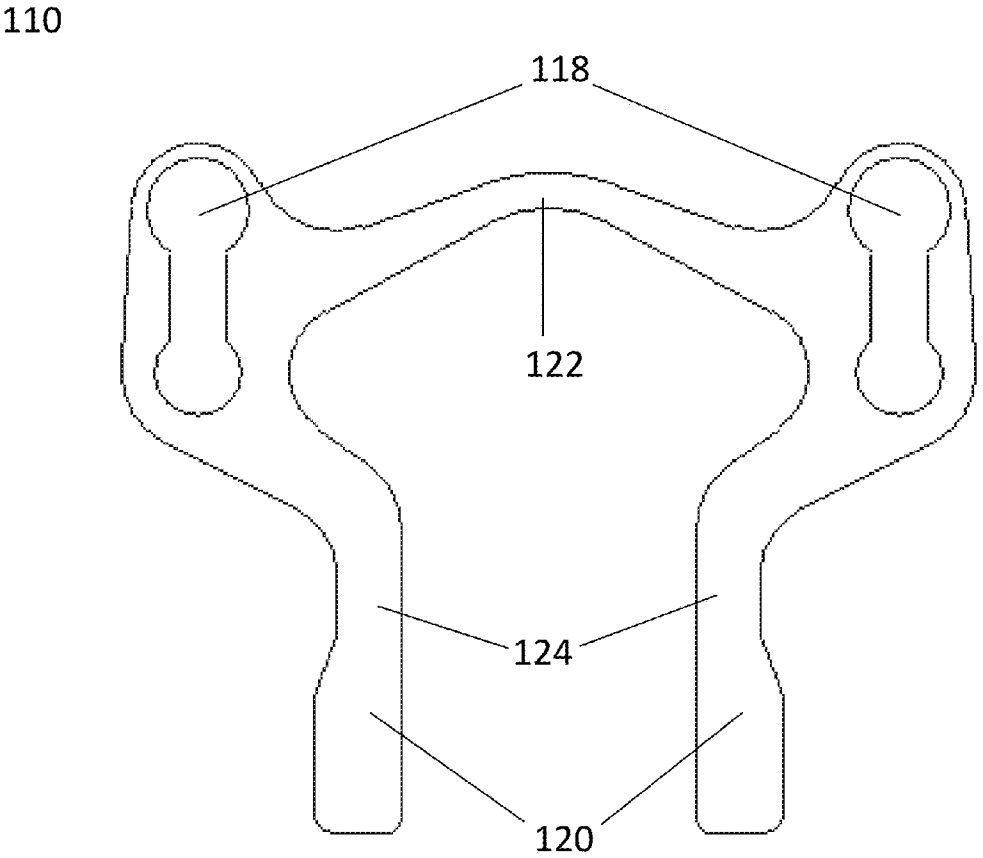
FIG. 4J is an exemplary embodiment of a mounting ring.

FIG. 4J illustrates an exemplary embodiment of a ring mount 110 with a large and quadrilaterally-shaped internal cavity. This internal cavity may be suitable to allow the ring mount 110 to be used in conjunction with even particularly large accessories, which may widen the scope of what such accessories may be used with a scope guard 100. The embodiment of FIG. 4J also features a curved, contoured design, which may allow the ring mount 110 to have adequate impact absorption capabilities without requiring that the ring mount 110 be excessively large.

Figure 4K:
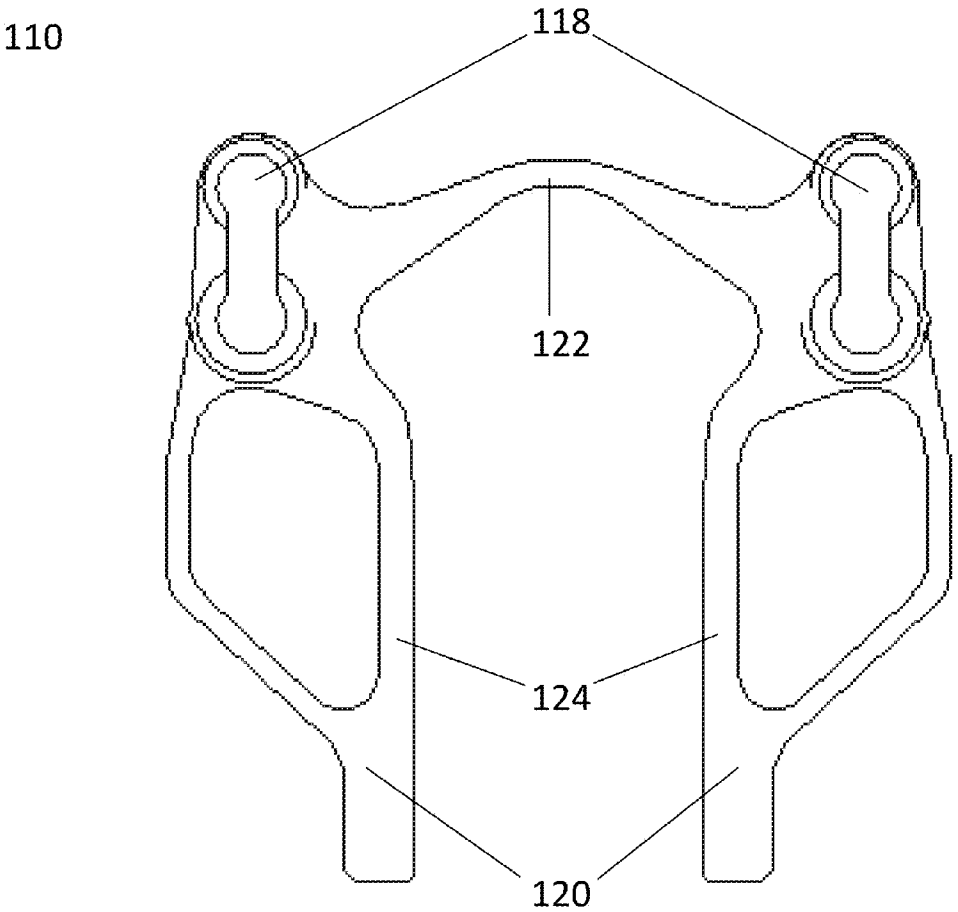
FIG. 4K is an exemplary embodiment of a mounting ring.

FIG. 4K illustrates an exemplary modified version of the previous ring mount 110 design as shown in FIG. 4J. The embodiment shown in FIG. 4K has a large quadrilaterally-shaped internal cavity that is nonetheless smaller than that of FIG. 4J; the ring mount 110 also features two widened vertical supports 124, which may, as discussed above, give the ring mount superior impact-absorption characteristics or may allow it to accommodate particularly wide or asymmetrical accessories.

According to other embodiments, scope guards 100 may be used to protect scopes and other easily-damaged accessories on other devices than weapons. For example, a scope guard 100 may substantially enclose the viewfinder on a camera or a portable telescope, which may protect the viewfinder from certain sources of damage. According to such an embodiment, the scope guard 100 may be affixed to a mounting bracket, or affixed directly to the viewfinder or other accessory in question if mounting brackets are not present.

The foregoing description and accompanying drawings illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. An apparatus for protecting weapons and weapon accessories, said apparatus comprising:

one or more mounts located on a lower portion of a mounting area on the apparatus, the one or more mounts attaching to corresponding mounting sites on an upper portion of a mounting area on a weapon and comprising two or more holes through which guard bars pass;

a frame affixed to the one or more mounts, including an internal cavity sized to substantially enclose a standard firearm accessory, and further including mounting sites for one or more panels, the frame further comprising the guard bars; and at least one panel removably affixed to the frame and supported by the guard bars.

2. The apparatus of claim 1, wherein the standard firearm accessory is one of a scope, a holographic sight, a red dot sight, and a reflex sight.

3. The apparatus of claim 1, wherein the at least one panel is camouflaged and wherein the panel is positioned to conceal the outline of the weapon.

4. The apparatus of claim 1, wherein the at least one panel is interchangeable with at least one other panel with different protective and visual characteristics.

5. The apparatus of claim 1, wherein the frame is constructed from at least one of: aluminum, magnesium, titanium, steel, plastics, composites, resins, epoxies, laminates, glass, and carbon fiber.

* * * * *